US008172526B2

(12) United States Patent
Lescure et al.

(10) Patent No.: US 8,172,526 B2
(45) Date of Patent: May 8, 2012

(54) SEALING A HUB CAVITY OF AN EXHAUST CASING IN A TURBOMACHINE

(75) Inventors: Xavier Firmin Camille Jean Lescure, Boulogne Billancourt (FR); Aurelien Rene-Pierre Massot, Vaux le Penil (FR); Sebastien Jean Laurent Prestel, Arpajon (FR); Christian Rene Schnell, Forges (FR)

(73) Assignee: SNECMA, Paris (FR)

( * ) Notice: Subject to any disclaimer, the term of this patent is extended or adjusted under 35 U.S.C. 154(b) by 689 days.

(21) Appl. No.: 12/330,909

(22) Filed: Dec. 9, 2008

(65) Prior Publication Data

US 2009/0155071 A1 Jun. 18, 2009

(30) Foreign Application Priority Data

Dec. 14, 2007 (FR) ..... 07 08713

(51) Int. Cl.
*F01D 25/12* (2006.01)
*F01D 25/24* (2006.01)
*F01D 25/16* (2006.01)

(52) U.S. Cl. ..... 415/213.1; 415/216.1

(58) Field of Classification Search ..... 415/213.1, 415/214.1, 281.1, 134, 136, 139, 173.7
See application file for complete search history.

(56) References Cited

U.S. PATENT DOCUMENTS

| | | | | |
|---|---|---|---|---|
| 6,511,284 | B2 * | 1/2003 | Darnell et al. | 415/115 |
| 6,612,807 | B2 * | 9/2003 | Czachor | 415/116 |
| 7,008,182 | B2 * | 3/2006 | Kopp et al. | 415/136 |
| 2006/0010852 | A1 | 1/2006 | Gekht et al. | |
| 2007/0280819 | A1 * | 12/2007 | Eleftheriou et al. | 415/115 |

FOREIGN PATENT DOCUMENTS

| | | |
|---|---|---|
| EP | 1 262 636 A2 | 12/2002 |
| JP | 9-324699 | 12/1997 |
| JP | 2003-20957 | 1/2003 |

OTHER PUBLICATIONS

Machine translation of JP 2003/020957.*

* cited by examiner

*Primary Examiner* — Benjamin Sandvik
*Assistant Examiner* — Joseph Schoenholtz
(74) *Attorney, Agent, or Firm* — Oblon, Spivak, McClelland, Maier & Neustadt, L.L.P.

(57) ABSTRACT

The exhaust casing of a turbomachine includes a cylindrical jacket for guiding a flow of exhaust gas and for defining a hub cavity inside the casing, the jacket including at its ends an annular flange and a radial annular portion extending inwards and formed with an annular rim that is designed to be received in an annular groove of the inner wall of the exhaust casing to close the hub cavity in substantially sealed manner.

10 Claims, 2 Drawing Sheets

SEALING A HUB CAVITY OF AN EXHAUST CASING IN A TURBOMACHINE

The present invention relates to an exhaust casing in a turbomachine, such as an airplane turbojet, and more particularly the invention relates to sealing a hub cavity in the exhaust casing.

TECHNOLOGICAL BACKGROUND OF THE INVENTION

The exhaust casing of a turbomachine is mounted downstream from a turbine and generally comprises two coaxial cylindrical walls, respectively a radially inner wall and a radially outer wall, which walls are interconnected by radial arms, the inner wall being surrounded by a cylindrical jacket for guiding a flow of exhaust gas coming from the turbine.

The cylindrical jacket has its downstream end fastened to the inner wall of the exhaust casing, and at its upstream end it has a radial annular portion that extends freely towards the axis of the turbomachine so that the cylindrical jacket and the inner wall of the exhaust casing together define a cavity, commonly referred to as a hub cavity.

This cavity is open at the inner end of the radial annular portion of the cylindrical jacket.

As a result, air coming from upstream flows in the hub cavity, this air penetrating into the cavity via its upstream opening and being taken from between the high-pressure and low-pressure compressors of the turbomachine, thereby having a negative influence on the fuel consumption of the turbomachine.

This flow of cool air in the hub cavity tends to cool the inner wall of the exhaust casing and the radially inner ends of the radial arms of said casing, while the radially outer portions of the arms are maintained at relatively high temperatures by the flow of exhaust gas. This leads to a large thermal gradient in the radial arms that can harm their lifetime.

In addition, because its radial annular portion is free, the cylindrical jacket presents modes of vibration that correspond substantially to the frequencies of the rotor(s) of the turbomachine, and can thus enter into resonance with the rotor(s), thereby generating strong vibration that can harm the lifetime of the cylindrical jacket.

SUMMARY OF THE INVENTION

A particular object of the invention is to provide a solution to these problems that is simple, inexpensive, and effective, enabling the drawbacks of the prior art to be avoided.

To this end, the invention provides a turbomachine exhaust casing comprising two coaxial cylindrical walls, respectively a radially inner wall and a radially outer wall, the walls being interconnected by radial arms, and a cylindrical jacket secured to the downstream end of the radially inner wall and co-operating with the radially inner wall to define a hub cavity and co-operating with the radially outer wall to define a flow space for exhaust gas, the upstream end of the cylindrical jacket including a radial annular portion extending towards the axis of the turbomachine, wherein the radial annular portion of the jacket includes at its inner end an annular rim that co-operates with the inner cylindrical wall of the exhaust casing by sliding radially in substantially sealed manner.

The annular rim of the radial portion of the cylindrical jacket serves to prevent air flowing into the hub cavity.

This enables the thermal gradient in the radial arms of the exhaust casing to be minimized, thereby increasing their lifetime, and this also reduces the amount of air taken from the compressors of the turbomachine.

The radially sliding connection serves to provide good sealing for the hub cavity, while avoiding mechanical stresses appearing in the cylindrical jacket as a result of the thermal expansion that takes place at the operating temperatures of the turbomachine.

In addition, holding the upstream end of the cylindrical jacket axially serves to raise the frequencies of the vibration modes of the jacket, thereby avoiding resonance phenomena, e.g. with the rotor of the turbomachine, which phenomena harm its lifetime.

According to another characteristic of the invention, the inner wall of the exhaust casing has two annular flanges, respectively an upstream flange and a downstream flange, the flanges extending radially outwards and being placed facing each other in such a manner as to form an annular groove for receiving the annular rim of the cylindrical jacket with axial clearance to provide a sealed connection between the cylindrical jacket and the radially inner wall that allows the annular rim of the jacket to move radially.

In a preferred embodiment of the invention, each of the two flanges of the inner wall of the exhaust casing presents a radial dimension that is greater than a maximum acceptable amplitude for radial displacement of the annular rim of the cylindrical jacket caused by thermal expansion thereof.

Thus, the annular rim of the cylindrical jacket does not risk disengaging from the annular groove formed by the two flanges of the inner wall of the exhaust casing under the effect of thermal expansion, at least so long as the radial movement of the annular rim does not exceed a maximum value corresponding to a predefined maximum temperature that the cylindrical jacket is in no danger of exceeding in normal operation of the turbomachine.

Preferably, the annular rim of the cylindrical jacket extends substantially to the bottom of the annular groove in the inner wall of the exhaust casing when the turbomachine is stopped.

This serves to maximize the amplitude of thermal expansion that is acceptable for the cylindrical jacket.

According to another characteristic of the invention, the cylindrical jacket is elastically prestressed when the turbomachine is in the stopped condition, in such a manner as to press the upstream face of the annular rim of its radial annular portion against the upstream annular flange of the inner wall of the exhaust casing as to provide sealing for the hub cavity.

Alternatively, the cylindrical jacket is elastically prestressed, when the turbomachine is in the stopped condition, in such a manner as to press the downstream face of the annular rim of its radial annular portion against the downstream annular flange of the inner wall of the exhaust casing, in order to provide sealing for the hub cavity.

Thermal expansion phenomena in operation then tend to move the annular rim upstream so that its upstream face is pressed against the upstream annular flange of the inner wall of the exhaust casing, thereby preserving sealing of the cavity.

Preferably, the annular rim of the radial annular portion of the cylindrical jacket includes a cylindrical collar at its radially outer end, the collar extending upstream and forming a radial abutment for bearing against the upstream annular flange of the inner wall of the exhaust casing.

In another embodiment of the invention, the radial annular portion of the cylindrical jacket includes orifices for passing a stream of cool air.

This embodiment is well adapted to circumstances in which the hub cavity needs to be ventilated. The size of the orifices can then be selected as a function of the level of ventilation required and enables the ventilation air flow rate to be controlled.

The invention also provides a cylindrical jacket for a turbomachine exhaust casing of the type described above, the jacket including at one of its ends an annular rim and at its other end a radial annular portion that extends inwards, wherein the radial annular portion includes at its radially inner end a radial annular rim formed with a cylindrical collar.

The invention also provides a turbomachine fitted with an exhaust casing as described above.

BRIEF DESCRIPTION OF THE DRAWINGS

The invention can be better understood and other details, advantages, and characteristics thereof appear more clearly on reading the following description made by way of non-limiting example and with reference to the accompanying drawings, in which.

DETAILED DESCRIPTION

Figure 1:
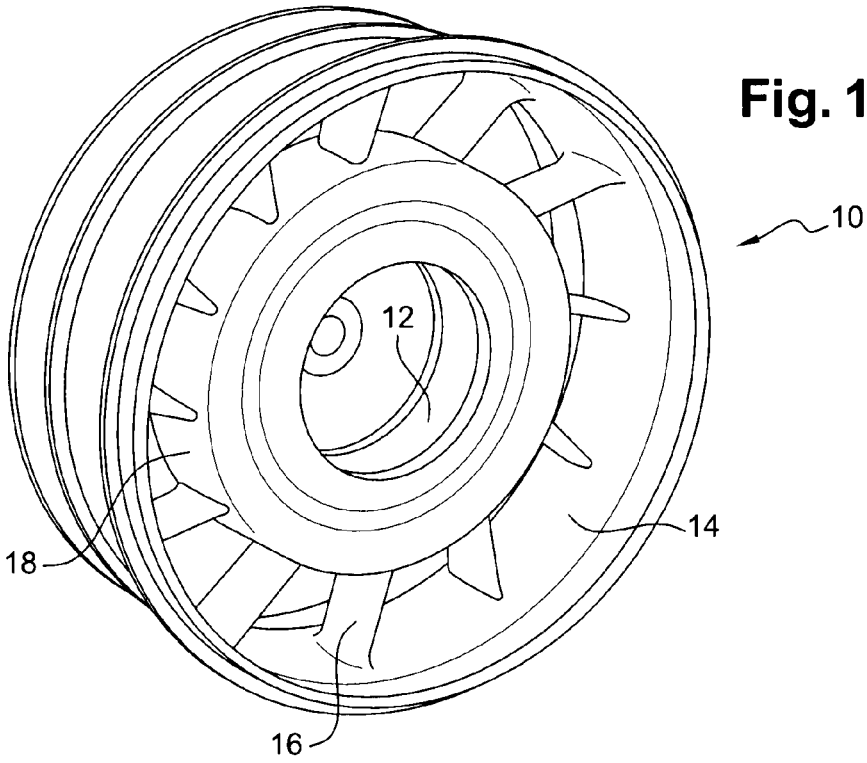
FIG. 1 is a diagrammatic perspective view of a turbomachine exhaust casing of the invention.

FIG. 1 shows a turbomachine exhaust casing 10 comprising two coaxial cylindrical walls, respectively a radially inner wall 12 and a radially outer wall 14, that are interconnected by structural radial arms 16.

A cylindrical jacket 18 is mounted around the radially inner wall 12 of the exhaust casing 10.

Figure 2:
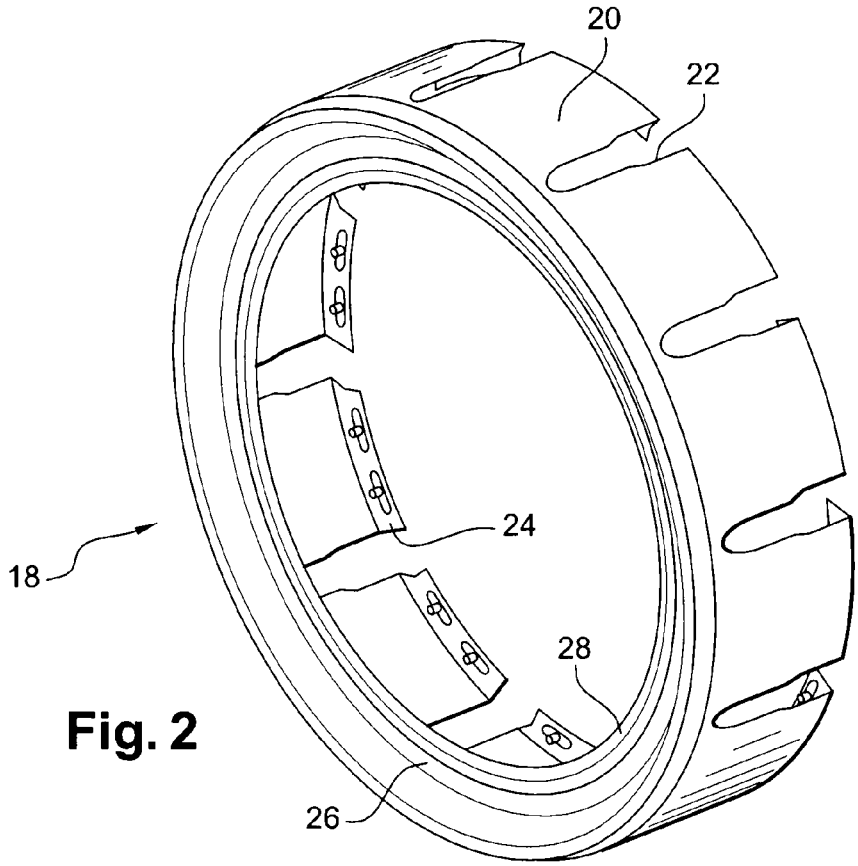
FIG. 2 is a diagrammatic perspective view of a cylindrical jacket of the invention for fitting to the FIG. 1 exhaust casing.

This jacket 18, shown on its own in FIG. 2, comprises a cylindrical wall 20 having cutouts 22 formed therein that are open in the downstream direction for receiving the radial arms 16 of the exhaust casing 10.

The cylindrical jacket 18 includes a radial annular flange 24 at its downstream end for fastening to the exhaust casing 10, and at its upstream end it includes a radial annular portion 26 that extends radially inwards.

As explained in greater detail below, according to the invention the jacket 18 includes an annular rim 28 formed at the radially inner end of its radial annular portion 26.

Figure 3:
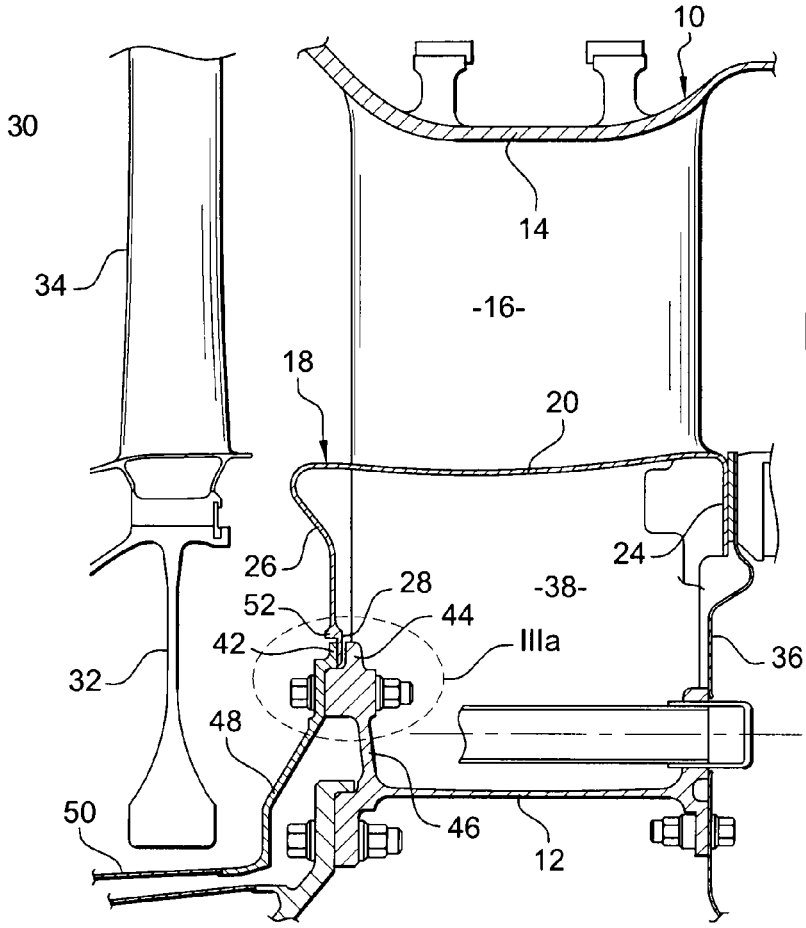
FIG. 3 is a fragmentary diagrammatic view in axial section of a turbomachine including the exhaust casing of FIG. 1.

The jacket 18 and the radially outer wall 14 of the exhaust casing define an annular flow space for exhaust gas within a turbomachine, as shown in part in FIG. 3.

FIG. 3 shows the exhaust casing 10 mounted downstream from a low pressure turbine 30, comprising disks 32 carrying blades 34 and driving in rotation a shaft connected to an upstream compressor (not shown), in well-known manner.

The exhaust casing 10 has a downstream radial wall 36 extending radially outwards from the downstream end of the inner wall 12 of the casing, and having fastened thereto the radial annular flange 24 of the cylindrical jacket.

The assembly formed by the inner wall 12 and the downstream radial wall 36 of the exhaust casing 10 together with the cylindrical jacket 18 defines a toroidal cavity 38 commonly referred to as the hub cavity.

In prior art turbomachines, the radial annular portion of the cylindrical jacket is free at its radially end and thus forms an annular opening in the hub cavity between the free end of said radial annular portion and the upstream end of the inner wall of the exhaust casing.

To avoid the drawbacks associated with that configuration, and as mentioned above with reference to FIG. 2, the cylindrical jacket 18 of the invention has an annular rim 28 formed at the inner end of the radial annular portion 26 of the jacket, and engaged as shown in FIG. 3 in an annular groove (FIG. 3*a*) that is outwardly open and that is formed by two radial flanges, respectively an upstream flange 42 and a downstream flange 44, that are placed facing each other and that are secured to the inner wall 12 of the exhaust casing 10 for the purpose of closing the hub cavity 38 in substantially leaktight manner, thereby preventing cool air from flowing into said cavity.

By way of example, the downstream flange 44 is formed at the radially outer end of a shroud 46 extending radially outwards from the upstream end of the inner wall 12 of the exhaust casing 10.

By way of example, the upstream flange 42 may be formed to extend a radial flange 48 for fastening an inner casing 50, commonly referred to as the oil-recovery casing, to the exhaust casing 10, the inner casing 50 extending axially between the turbine shaft and the disks 32 of the rotor of said turbine, upstream from the exhaust casing 10.

Furthermore, the annular rim 28 of the cylindrical jacket 18 includes at its radially outer end a cylindrical collar 52 extending upstream and forming a radial abutment for bearing against the upstream annular flange 42 of the inner wall 12 of the exhaust casing 10.

Figure 3A:
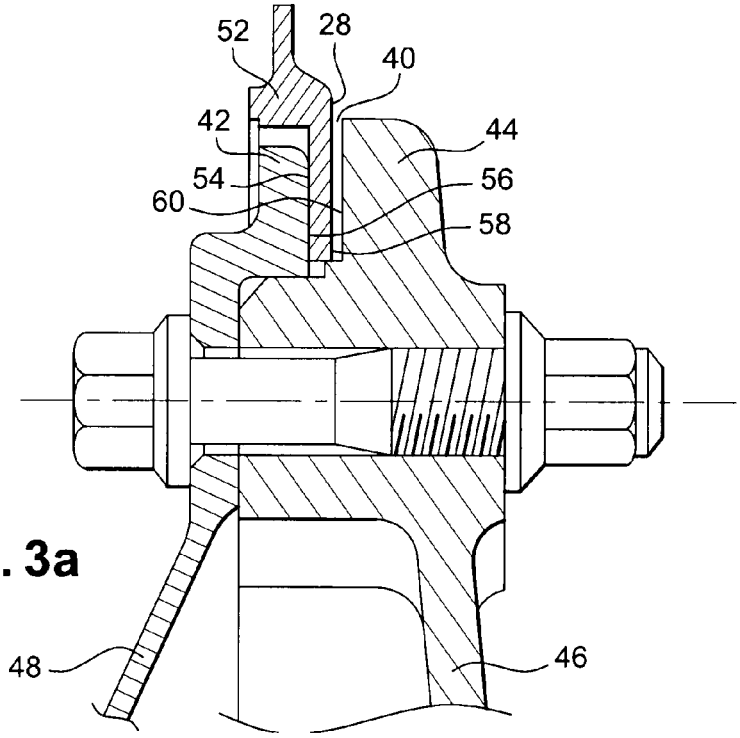
FIG. 3*a* is an enlarged view of detail IIIa of FIG. 3.

As can be seen in FIG. 3*a*, the axial extent of the annular groove 40 is a little greater than the thickness of the annular rim 28 of the cylindrical jacket 18 such that the rim is engaged with axial clearance, e.g. of the order of 1 millimeter (mm), in the groove 40, so as to allow the annular rim 28 to slide radially in the groove 40.

This ability of the rim 28 to move radially inside the groove 40 serves to avoid mechanical stresses appearing in the cylindrical jacket 18 as a result of the thermal expansion phenomena induced by the temperature rising in the exhaust casing 10 while the turbomachine is in operation.

Furthermore, the cylindrical jacket 18 is formed in such a way that at ambient temperature, when the turbomachine is stopped, the annular rim 28 extends substantially to the bottom of the annular groove 40.

This serves to maximize the amount of outward radial movement of the annular rim 28 that can be accepted, i.e. to maximize the radial movement beyond which the rim 28 disengages from the annular groove 40 under the effect of thermal expansion of the cylindrical jacket 18.

The radial flanges 42 and 44 of the exhaust casing present radial dimensions that are greater than a value for the radial movement of the annular rim 28 that is considered as being the maximum acceptable value under normal operating conditions of the turbomachine, so as to avoid any risk of the rim 28 disengaging from the groove 40.

In addition, the cylindrical jacket 18 is axially prestressed, so that when the turbomachine is in the stopped condition, the jacket presses the upstream face 54 of its annular rim 28 against the downstream face 56 of the upstream flange 42 of the inner wall 12 of the exhaust casing 10, so as to provide best sealing for the connection between the cylindrical jacket 18 and the inner wall 12 of the casing.

In operation, the thermal expansion of the cylindrical jacket tends to further increase the pressure exerted by the rim 28 on the upstream flange 42 of the casing, so that the sealing of the hub cavity 38 is ensured on a permanent basis.

Alternatively, the cylindrical jacket 18 may be axially prestressed to press the downstream face 58 of the annular rim 28 against the upstream face 60 of the downstream flange 44 of the inner wall 12 of the exhaust casing 10. Under such circumstances, if the air pressure inside the hub cavity 38 becomes greater than the air pressure upstream from the exhaust casing, or if thermal expansion of the cylindrical jacket 18 leads to its annular rim 28 moving upstream, then the rim is quickly pressed against the upstream flange 42 of the exhaust casing, so that the sealing of the hub cavity 38 is preserved.

Because its upstream end is held in place, the cylindrical jacket 18 presents natural modes of vibration at frequencies that are higher than in the prior art.

This considerably reduces any risk of resonance between the jacket 18 and the turbomachine rotor, thereby improving the lifetime of the jacket 18.

In addition, as explained above, sealing the hub cavity 38 serves to improve the lifetime of the radial arms 16 of the exhaust casing.

Nevertheless, it might be necessary to maintain a certain level of ventilation in the hub cavity 38, in which case it can be advantageous to provide air inlet orifices of determined diameter in the radial annular portion 26 of the jacket 18.

What is claimed is:

1. A turbomachine exhaust casing, comprising:

two coaxial cylindrical walls, respectively a radially inner wall and a radially outer wall, the walls being interconnected by radial arms; and a cylindrical jacket secured to a downstream end of the radially inner wall and co-operating with the radially inner wall to define a hub cavity and co-operating with the radially outer wall to define a flow space for exhaust gas, an upstream end of the cylindrical jacket including a radial annular portion extending toward an axis of the turbomachine, wherein the radial annular portion of the cylindrical jacket includes at its radially inner end an annular rim that co-operates with the radially inner wall of the exhaust casing by sliding radially in a substantially sealed manner.

2. The exhaust casing according to claim 1, wherein:

an upstream end of the radially inner wall has two annular flanges, respectively an upstream flange and a downstream flange, the two annular flanges extend radially outward and face each other in such a manner as to form an annular groove for receiving the annular rim of the cylindrical jacket with axial clearance, and the annular rim is disposed within the annular groove to provide a sealed connection between the cylindrical jacket and the radially inner wall that allows the annular rim of the cylindrical jacket to move radially.

3. The exhaust casing according to claim 2, wherein each of the two flanges of the inner wall of the exhaust casing presents a radial dimension that is greater than a maximum acceptable amplitude for radial displacement of the annular rim of the cylindrical jacket caused by thermal expansion thereof.

4. The exhaust casing according to claim 2, wherein the annular rim of the cylindrical jacket extends substantially to a bottom of the annular groove in the inner wall of the exhaust casing when the turbomachine is stopped.

5. The exhaust casing according to claim 2, wherein the cylindrical jacket is prestressed when the turbomachine is in a stopped condition, in such a manner as to press an upstream face of the annular rim of its radial annular portion against the upstream annular flange of the inner wall of the exhaust casing as to provide sealing for the hub cavity.

6. The exhaust casing according to claim 2, wherein the cylindrical jacket is prestressed, when the turbomachine is in a stopped condition, in such a manner as to press a downstream face of the annular rim of its radial annular portion against the downstream annular flange of the inner wall of the exhaust casing, in order to provide sealing for the hub cavity.

7. The exhaust casing according to claim 1, wherein the annular rim of the radial annular portion of the cylindrical jacket includes a cylindrical collar at its radially outer end, the collar extending upstream and forming a radial abutment for bearing against the upstream annular flange of the inner wall of the exhaust casing.

8. The exhaust casing according to claim 1, wherein the radial annular portion of the cylindrical jacket includes orifices for passing a stream of ventilation air.

9. The exhaust casing according to claim 1, wherein:

the cylindrical jacket includes at one of its ends an annular rim and includes at its other end a radial annular portion that extends inward, and the radial annular portion includes at its radially inner end a radial annular rim formed with a cylindrical collar.

10. A turbomachine, including an exhaust casing according to claim 1.

* * * * *